US010815821B2

(12) United States Patent
Sener et al.

(10) Patent No.: US 10,815,821 B2
(45) Date of Patent: Oct. 27, 2020

(54) VARIABLE AIRFOIL WITH SEALED FLOWPATH

(71) Applicant: General Electric Company, Schenectady, NY (US)

(72) Inventors: Alexander Martin Sener, Cincinnati, OH (US); Frederick Martin Heise, Cincinnati, OH (US); Monty Lee Shelton, Loveland, OH (US)

(73) Assignee: General Electric Company, Schenectady, NY (US)

( * ) Notice: Subject to any disclaimer, the term of this patent is extended or adjusted under 35 U.S.C. 154(b) by 36 days.

(21) Appl. No.: 16/118,556

(22) Filed: Aug. 31, 2018

(65) Prior Publication Data

US 2020/0072075 A1 Mar. 5, 2020

(51) Int. Cl.
*F01D 17/16* (2006.01)
*F01D 11/00* (2006.01)

(52) U.S. Cl.
CPC ..... *F01D 17/165* (2013.01); *F01D 11/005* (2013.01); *F05D 2220/32* (2013.01)

(58) Field of Classification Search
CPC .. F01D 9/041; F01D 17/162; F05D 2240/122; F05D 2240/123; F05D 2240/124; F05D 2250/90
See application file for complete search history.

(56) References Cited

U.S. PATENT DOCUMENTS

| | | | | |
|---|---|---|---|---|
| 2,979,809 | A | 4/1961 | Dennis | |
| 3,606,580 | A | 9/1971 | Kaufman, Sr. | |
| 3,650,635 | A | 3/1972 | Wachtell et al. | |
| 4,792,295 | A | 12/1988 | Joyce, Sr. | |
| 5,044,881 | A | 9/1991 | Dodd et al. | |
| 5,332,357 | A * | 7/1994 | Tubbs | F01D 5/147 415/115 |
| 5,931,636 | A * | 8/1999 | Savage | F01D 17/141 415/115 |
| 6,375,419 | B1 | 4/2002 | LeJambre et al. | |
| 6,382,906 | B1 | 5/2002 | Brassfield et al. | |
| 6,619,916 | B1 * | 9/2003 | Capozzi | F01D 5/148 415/160 |
| 8,033,790 | B2 | 10/2011 | Vance | |
| 8,056,336 | B2 | 11/2011 | Arnold et al. | |
| 8,317,465 | B2 | 11/2012 | Smith | |
| 9,121,301 | B2 | 9/2015 | Floyd et al. | |
| 9,546,562 | B2 | 1/2017 | Hillier | |
| 9,593,587 | B2 | 3/2017 | Matsumoto et al. | |
| 9,617,864 | B2 * | 4/2017 | Firnhaber | F01D 9/041 |

(Continued)

*Primary Examiner* — Ninh H. Nguyen
(74) *Attorney, Agent, or Firm* — Dority & Manning, P.A.

(57) ABSTRACT

A stage of guide vanes for a machine includes a first variable vane assembly including an airfoil. The airfoil of the first variable vane assembly includes a first member and a second member each extending generally along a radial direction and the second member being moveable relative to the first member. The stage of guide vanes also includes a second variable vane assembly including an airfoil, the airfoil of the second variable vane assembly including a first member and a second member each extending generally along the radial direction and the second member being moveable relative to the first member, the second members of the airfoils of the first and second variable vane assemblies being moveable towards one another.

20 Claims, 8 Drawing Sheets

(56) References Cited

U.S. PATENT DOCUMENTS

| | | | |
|---|---|---|---|
| 2013/0084169 | A1 | 4/2013 | Kareff et al. |
| 2015/0285157 | A1 | 10/2015 | Burdick et al. |
| 2015/0337664 | A1 | 11/2015 | Cosi et al. |
| 2016/0258309 | A1 | 9/2016 | Wilber |
| 2016/0341068 | A1 | 11/2016 | Robertson, Jr. et al. |

* cited by examiner

VARIABLE AIRFOIL WITH SEALED FLOWPATH

FEDERALLY SPONSORED RESEARCH

This invention was made with government support under contact number FA8650-15-D-2501 awarded by the Department of the Air Force. The U.S. government may have certain rights in the invention.

FIELD

The present subject matter relates generally to gas turbine engines. More particularly, the present subject matter relates to sealing assemblies for variable vanes in gas turbine engines.

BACKGROUND

Gas turbine engines generally include a compressor section, a combustion section, and a turbine section in serial flow order. The compressor section may include one or more compressors, each of the one or more compressors typically including sequential stages of compressor rotor blades and compressor stator vanes. Similarly, the turbine section may include one or more turbines, each of the one or more turbines typically including sequential stages of turbine rotor blades and turbine stator vanes.

The stages of stator vanes in the one or more compressors and/or the one or more turbines may change a direction of an airflow thereacross in order to increase a performance and efficiency of the gas turbine engine. The performance and efficiency of the gas turbine engine may further be increased by including stator vanes in the one or more compressors and/or the one or more turbines capable of rotating about an axis in order to vary a direction in which the stator vanes change the airflow thereacross. These are commonly referred to as variable stator vanes.

Despite the increases in performance and efficiency derived from the inclusion of variable stator vanes in the one or more compressors and/or the one or more turbines, in at least certain engines, at least a portion of the airflow thereacross may be capable of leaking around a radially inner end and/or a radially outer end of the variable stator vanes by virtue of the variable stator vanes not being fixedly attached to a respective radially inner or radially outer band. Such may have a detrimental effect on the gas turbine engine's performance, efficiency, and durability.

Accordingly, a stator vane assembly capable of varying a direction in which it directs airflow thereacross while minimizing an amount of leakage around its radially inner and/or radially outer ends would be useful.

BRIEF DESCRIPTION

Aspects and advantages of the invention will be set forth in part in the following description, or may be obvious from the description, or may be learned through practice of the invention.

In one exemplary embodiment of the present disclosure, a stage of guide vanes for a machine defining a radial direction is provided. The stage of guide vanes includes a first variable vane assembly including an airfoil, the airfoil of the first variable vane assembly including a first member and a second member each extending generally along the radial direction and the second member being moveable relative to the first member. The stage of guide vanes also includes a second variable vane assembly including an airfoil, the airfoil of the second variable vane assembly including a first member and a second member each extending generally along the radial direction and the second member being moveable relative to the first member, the second members of the airfoils of the first and second variable vane assemblies being moveable towards one another.

In certain exemplary embodiments the second members are variable members, and wherein the first members are fixed members.

In certain exemplary embodiments the second members each includes an upstream section and a downstream section, wherein the upstream section of the second member of the airfoil of the first variable vane assembly is moveable towards the downstream section of the second member of the airfoil of the second variable vane assembly, and wherein the downstream section of the second member of the airfoil of the second variable vane assembly is moveable towards the upstream section of the second member of the airfoil of the first variable vane assembly.

In certain exemplary embodiments the second members of the airfoils of the first and second variable vane assemblies are further moveable away from one another.

For example, in certain exemplary embodiments the second members each includes an upstream second and a downstream section, wherein the upstream section of the second member of the airfoil of the first variable vane assembly is moveable away from the downstream section of the second member of the airfoil of the second variable vane assembly, and wherein the downstream section of the second member of the airfoil of the second variable vane assembly is moveable away from the upstream section of the second member of the airfoil of the first variable vane assembly.

In certain exemplary embodiments the airfoils each define a suction side, a pressure side, a leading edge, and a trailing edge, wherein the second member of each airfoil defines at least seventy percent of the suction side of the respective airfoil.

For example, in certain exemplary embodiments the airfoils each extend between a radially inner end and a radially outer end, wherein the first member and the second member of each airfoil together form a first seal interface and a second seal interface, wherein the first seal interface and the second seal interface of each airfoil extends along the radial direction between the radially inner end and the radially outer end of the respective airfoil, wherein the first seal interface of each airfoil is located on the pressure side of the respective airfoil, and wherein the second member further defines the pressure side between the trailing edge and the first seal interface.

For example, in certain exemplary embodiments the second seal interface of each airfoil is positioned proximate the leading edge of the respective airfoil, and wherein the first member of each airfoil defines at least the pressure side of the respective airfoil between the first seal interface and the second seal interface.

For example, in certain exemplary embodiments the first seal interface further includes a seal element positioned between the first variable seal surface and the first fixed seal surface.

In certain exemplary embodiments the first and second variable vane assemblies each further includes an airfoil band section, wherein each airfoil defines a leading edge and a trailing edge, wherein the second member of each airfoil is a variable member moveably coupled to the respective airfoil band section and defining a pivot axis, and wherein the pivot axis of the second member of each airfoil is positioned proximate the trailing edge of the respective airfoil.

In certain exemplary embodiments the first and second variable vane assemblies each further includes an airfoil band section, wherein the first member of each airfoil is a fixed member fixedly positioned relative to the respective airfoil band section, wherein the second member of each airfoil is a variable member moveably positioned relative to the respective airfoil band section and defining a pivot axis, wherein the fixed member and the variable member of each airfoil together define a first seal interface, wherein the first seal interface of each airfoil is formed by a first fixed seal surface of the respective fixed member and a first variable seal surface of the respective variable member, wherein the respective first fixed seal surface defines a curved shape in a reference plane perpendicular to the respective pivot axis, and wherein the respective first variable seal surface also defines a curved shape in the reference plane perpendicular to the respective pivot axis.

In certain exemplary embodiments the first and second variable vane assemblies each further includes an airfoil band section, wherein the second member of each airfoil is a variable member moveably coupled to the respective airfoil band section and defining a pivot axis, wherein each variable member includes a body and a circular base attached to or formed integrally with the body, wherein each airfoil band section defines a circular opening, and wherein the circular base of the variable member of the airfoil of each variable vane assembly is movably received within the circular opening of the airfoil band section of the respective variable vane assembly.

For example, in certain exemplary embodiments the first member of each airfoil is a fixed member fixedly attached to, or formed integrally with, the airfoil band section of the respective variable vane assembly, wherein the fixed member and the variable member of each airfoil together form a first seal interface and a second seal interface, wherein each airfoil defines a pressure side and a trailing edge, wherein the first seal interface of each airfoil is positioned on the pressure side of the respective airfoil, wherein each variable member defines a pressure side length between the respective first seal interface and the trailing edge, wherein the circular base of each variable member defines a diameter, and wherein the diameter of each circular base is greater than or equal to about fifty percent of the pressure side length of the respective variable member.

For example, in certain exemplary embodiments each variable member further includes a seal positioned between the circular base and the respective airfoil band section.

In certain exemplary embodiments the stage of guide vanes is a stage of variable guide vane assemblies, wherein the machine is a gas turbine engine, and wherein the stage of variable guide vane assemblies is configured for installation within a turbine section of the gas turbine engine.

In another exemplary embodiment a variable vane assembly for a machine is provided. The variable vane assembly includes an airfoil band defining a circular opening; and an airfoil defining a first side and a trailing edge and including a first member and a second member. The first member and second member define an interface at the first side and the airfoil defines a first side length between the interface and the trailing edge, the second member being a variable member moveably coupled to the airfoil band and defining a pivot axis, wherein the variable member includes a body and a circular base attached to or formed integrally with the body, the circular base being movably received within the circular opening of the airfoil band about the pivot axis and defining a diameter greater than about twenty-five percent of the first side length.

In certain exemplary embodiments the first member is a fixed member fixedly attached to, or formed integrally with, the airfoil band, wherein the first interface is a first seal interface, wherein the first side of the airfoil is a pressure side of the airfoil and the first side length is a pressure side length, and wherein the diameter of the circular base is greater than or equal to about seventy-five percent of the pressure side length and up to about one hundred and twenty percent the pressure side length.

In another exemplary embodiment a variable vane assembly for a machine is provided. The variable vane assembly includes an airfoil defining a leading edge, a trailing edge, a pressure side, and a suction side, the airfoil including a fixed member and a variable member each extending generally along the radial direction and the variable member being moveable relative to the fixed member, the variable member substantially defining the suction side and the fixed member and variable member together defining the pressure side.

In certain exemplary embodiments the airfoil extends between a radially inner end and a radially outer end, wherein the fixed member and the variable member together form a first seal interface and a second seal interface, wherein the first seal interface and the second seal interface each extend along the radial direction between the radially inner end and the radially outer end, wherein the first seal interface is located on the pressure side, and wherein the variable member defines the pressure side between the trailing edge and the first seal interface.

In certain exemplary embodiments the second seal interface is positioned proximate the leading edge of the airfoil, and wherein the fixed member defines the pressure side between the first seal interface and the second seal interface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
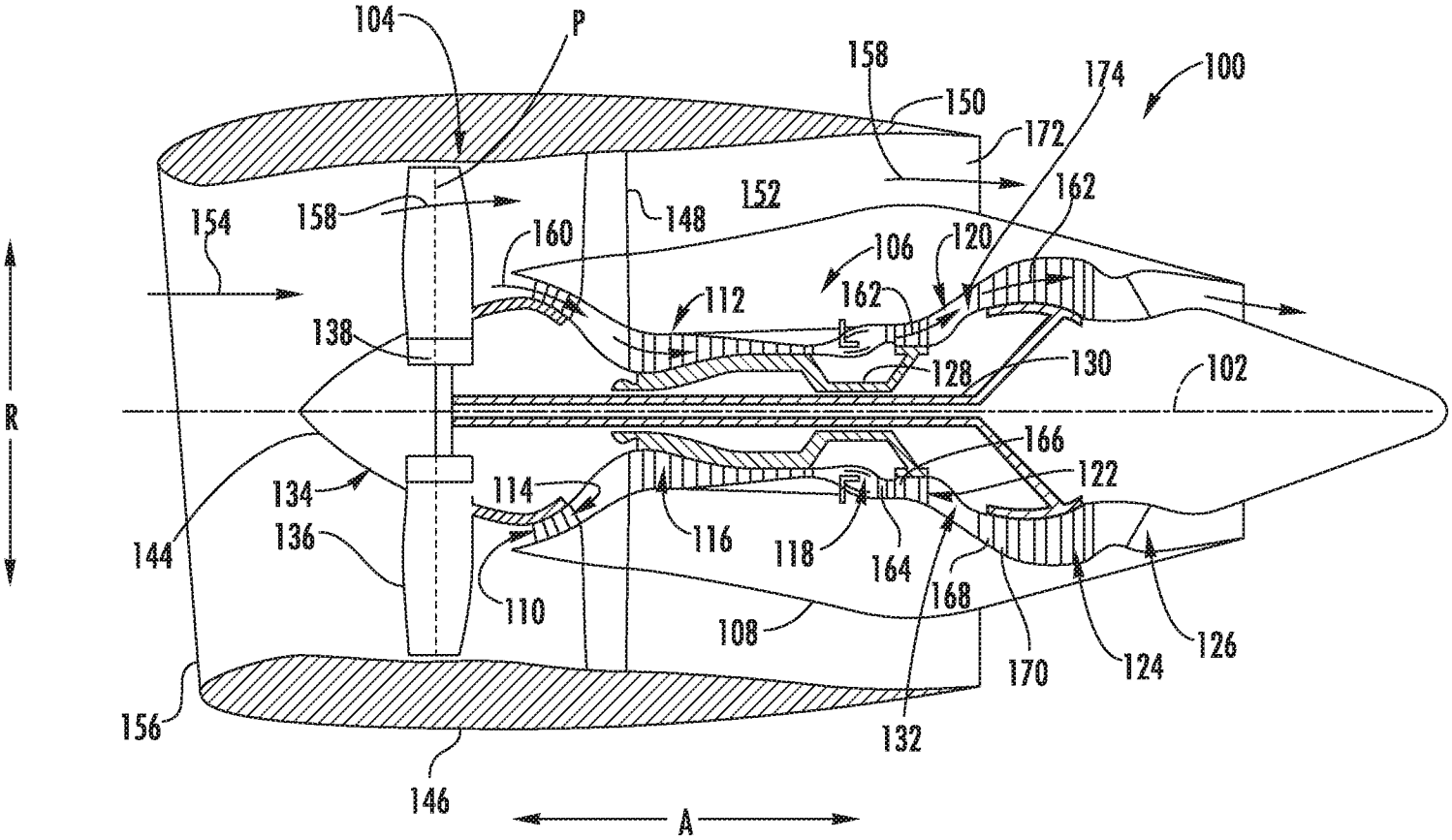
FIG. 1 is a schematic cross-sectional view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Referring now to the drawings, FIG. 1 is a schematic cross-sectional view of a gas turbine engine 100 in accordance with an exemplary embodiment of the present disclosure. More particularly, for the embodiment of FIG. 1, the gas turbine engine 100 is an aeronautical, high-bypass turbofan jet engine configured to be mounted to an aircraft, such as in an under-wing configuration or tail-mounted configuration. As shown in FIG. 1, the gas turbine engine 100 defines an axial direction A (extending parallel to or coaxial with a longitudinal centerline 102 provided for reference), a radial direction R, and a circumferential direction C (i.e., a direction extending about the axial direction A; see FIG. 3). In general, the gas turbine engine 100 includes a fan section 104 and a turbomachine 106 disposed downstream from the fan section 104. Accordingly, the exemplary gas turbine engine 100 may be referred to as a "turbofan engine."

The exemplary turbomachine 106 depicted generally includes a substantially tubular outer casing 108 that defines an annular inlet 110. The outer casing 108 encases, in serial flow relationship, a compressor section 112 including a first, booster or LP compressor 114 and a second, HP compressor 116; a combustion section 118; a turbine section 120 including a first, HP turbine 122 and a second, LP turbine 124; and a jet exhaust nozzle section 126. An HP shaft or spool 128 drivingly connects the HP turbine 122 to the HP compressor 116. An LP shaft or spool 130 drivingly connects the LP turbine 124 to the LP compressor 114. The compressor section, combustion section 118, turbine section, and jet exhaust nozzle section 126 together define a core air flowpath 132 through the turbomachine 106.

Referring still the embodiment of FIG. 1, the fan section 104 includes a fan 134 having a plurality of fan blades 136 coupled to a disk 138 in a circumferentially spaced apart manner. As depicted, the fan blades 136 extend outwardly from disk 138 generally along the radial direction R. The fan blades 136 and disk 138 are together rotatable about the longitudinal centerline 102 by LP shaft 130.

Referring still to the exemplary embodiment of FIG. 1, the disk 138 is covered by rotatable front nacelle 144 aerodynamically contoured to promote an airflow through the plurality of fan blades 136. Additionally, the exemplary fan section 104 includes an annular fan casing or outer nacelle 146 that circumferentially surrounds the fan 134 and/or at least a portion of the turbomachine 106. Moreover, for the embodiment depicted, the nacelle 146 is supported relative to the turbomachine 106 by a plurality of circumferentially spaced outlet guide vanes 148. Further, a downstream section 150 of the nacelle 146 extends over an outer portion of the turbomachine 106 so as to define a bypass airflow passage 152 therebetween.

During operation of the gas turbine engine 100, a volume of air 154 enters the gas turbine engine 100 through an associated inlet 156 of the nacelle 146 and/or fan section 104. As the volume of air 154 passes across the fan blades 136, a first portion of the air 154 as indicated by arrows 158 is directed or routed into the bypass airflow passage 152 and a second portion of the air 154 as indicated by arrow 160 is directed or routed into the LP compressor 114. The pressure of the second portion of air 160 is then increased as it is routed through the high pressure (HP) compressor 116 and into the combustion section 118.

Referring still to FIG. 1, the compressed second portion of air 160 from the compressor section mixes with fuel and is burned within the combustion section 118 to provide combustion gases 162. The combustion gases 162 are routed from the combustion section 118 along the hot gas path 174, through the HP turbine 122 where a portion of thermal and/or kinetic energy from the combustion gases 162 is extracted via sequential stages of HP turbine stator vanes 164 that are coupled to the outer casing 108 and HP turbine rotor blades 166 that are coupled to the HP shaft or spool 128, thus causing the HP shaft or spool 128 to rotate, thereby supporting operation of the HP compressor 116. The combustion gases 162 are then routed through the LP turbine 124 where a second portion of thermal and kinetic energy is extracted from the combustion gases 162 via sequential stages of LP turbine stator vanes 168 that are coupled to the outer casing 108 and LP turbine rotor blades 170 that are coupled to the LP shaft or spool 130, thus causing the LP shaft or spool 130 to rotate, thereby supporting operation of the LP compressor 114 and/or rotation of the fan 134.

The combustion gases 162 are subsequently routed through the jet exhaust nozzle section 126 of the turbomachine 106 to provide propulsive thrust.

Simultaneously, the pressure of the first portion of air 158 is substantially increased as the first portion of air 158 is routed through the bypass airflow passage 152 before it is exhausted from a fan nozzle exhaust section 172 of the gas turbine engine 100, also providing propulsive thrust. The HP turbine 122, the LP turbine 124, and the jet exhaust nozzle section 126 at least partially define a hot gas path 174 for routing the combustion gases 162 through the turbomachine 106.

It will be appreciated that the exemplary gas turbine engine 100 depicted in FIG. 1 is by way of example only, and that in other exemplary embodiments, the gas turbine engine 100 may have any other suitable configuration. For example, in other embodiments, the gas turbine engine 100 may be a variable bypass engine, may include a power gearbox, may include a variable-pitch fan, etc. Additionally, or alternatively, aspects of the present disclosure may be utilized with any other suitable aeronautical gas turbine engine, such as a turboshaft engine, turboprop engine, turbojet engine, etc. Further, aspects of the present disclosure may further be utilized with any other land-based gas turbine engine, such as a power generation gas turbine engine, or any aeroderivative gas turbine engine, such as a nautical gas turbine engine.

Figure 2:
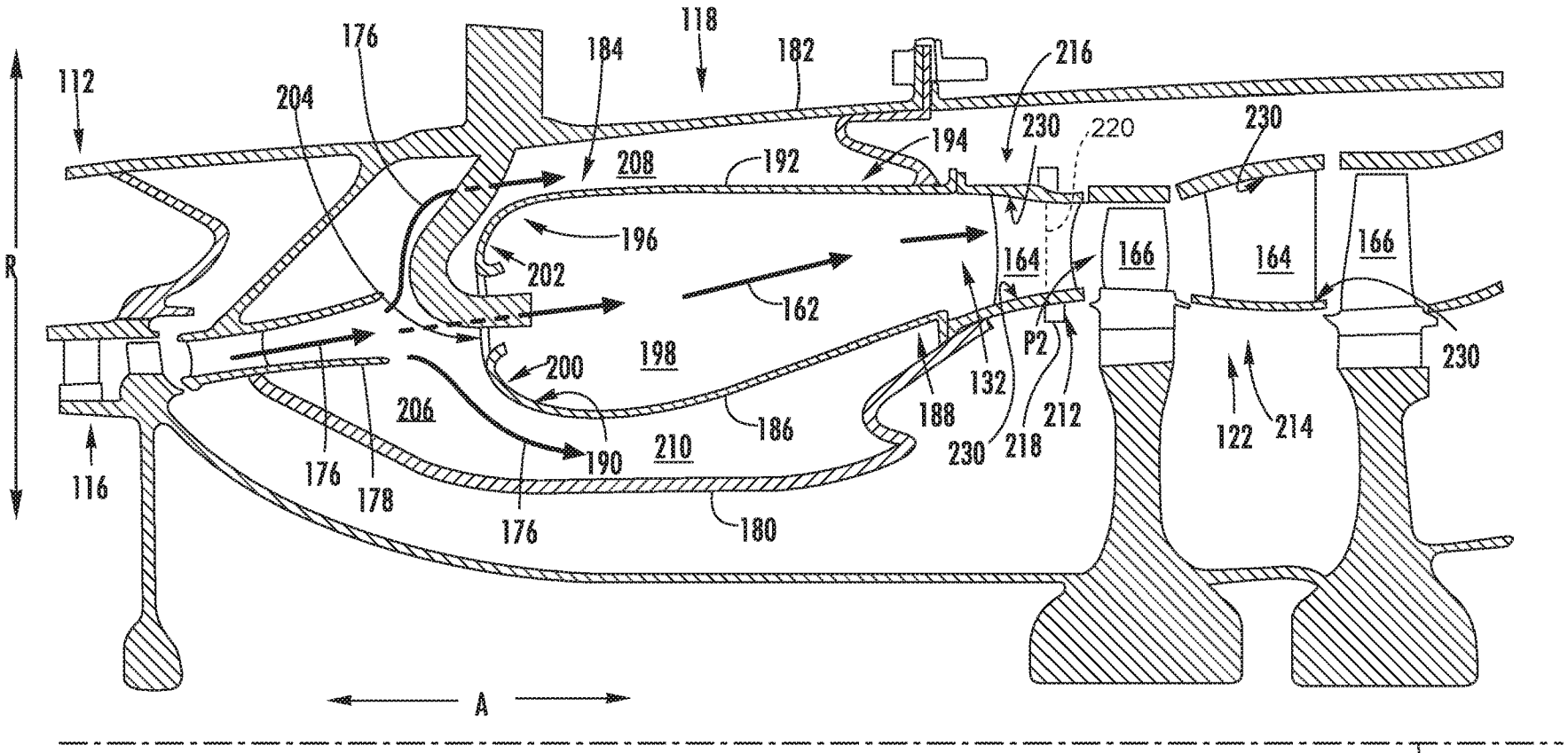
FIG. 2 is a side cross-sectional view of a compressor section, a combustion section, and a high pressure turbine section of the gas turbine engine shown in FIG. 1.

FIG. 2 provides a side cross-sectional view of the compressor section 112, combustion section 118, and the turbine section 120 of the turbomachine 106 of FIG. 1. More specifically, the rear end of the HP compressor 116, the combustor section 118, and the forward end of the HP turbine 122 are illustrated.

Compressed air 176 exits the HP compressor 116 through a diffuser 178 located at the rear end or outlet of the HP compressor 116 and diffuses into the combustion section 118. The combustion section 118 of turbomachine 106 is annularly encased by radially inner and outer combustor casings 180, 182. The radially inner combustor casing 180 and the radially outer combustor casing 182 both extend generally along the axial direction A and surround a combustor assembly 184 in annular rings. The inner and outer combustor casings 180, 182 are joined together at annular diffuser 178 at the forward end of the combustion section 118.

As shown, the combustor assembly 184 generally includes an inner liner 186 extending between a rear end 188 and a forward end 190 generally along the axial direction A, as well as an outer liner 192 also extending between a rear end 194 and a forward end 196 generally along the axial direction A. The inner and outer liners 186, 192 together at least partially define a combustion chamber 198 therebetween. The inner and outer liners 186, 192 are each attached to or formed integrally with an annular dome. More particularly, the annular dome includes an inner dome section 200 formed integrally with the forward end 190 of the inner liner 186 and an outer dome section 202 formed generally with the forward end 196 of the outer liner 192. Further, the inner and outer dome section 200, 202 may each be formed integrally (or alternatively may be formed of a plurality of components attached in any suitable manner) and may each extend along the circumferential direction C to define an annular shape. It should be appreciated, however, that in other embodiments, the combustor assembly 184 may not include the inner and/or outer dome sections 200, 202; may include separately formed inner and/or outer dome sections 200, 202 attached to the respective inner liner 186 and outer liner 192; or may have any other suitable configuration.

Referring still to FIG. 2, the combustor assembly 184 further includes a plurality of fuel air mixers 204 spaced along the circumferential direction C and positioned at least partially within the annular dome. More particularly, the plurality of fuel air mixers 204 are disposed at least partially between the outer dome section 202 and the inner dome section 200 along the radial direction R. Compressed air 176 from the compressor section 112 of the gas turbine engine 100 flows into or through the fuel air mixers 204, where the compressed air 176 is mixed with fuel and ignited to create combustion gases 162 within the combustion chamber 198. The inner and outer dome sections 200, 202 are configured to assist in providing such a flow of compressed air 176 from the compressor section 112 into or through the fuel air mixers 204.

As discussed above, the combustion gases 162 flow from the combustion chamber 198 into and through the turbine section 120 of the gas turbine engine 100, where a portion of thermal and/or kinetic energy from the combustion gases 162 is extracted via sequential stages of turbine stator vanes and turbine rotor blades within the HP turbine 122 and LP turbine 124. More specifically, as is depicted in FIG. 2, combustion gases 162 from the combustion chamber 198 flow into the HP turbine 122, located immediately downstream of the combustion chamber 198, where thermal and/or kinetic energy from the combustion gases 162 is extracted via sequential stages of HP turbine stator vanes 164 (discussed in greater detail below) and HP turbine rotor blades 166.

As illustrated in FIG. 2, not all compressed air 176 flows into or directly through the fuel air mixers 204 and into combustion chamber 198. Some of the compressed air 176 is discharged into a plenum 206 surrounding the combustor assembly 184. Plenum 206 is generally defined between the combustor casings 180, 182 and the liners 186, 192. The outer combustor casing 182 and the outer liner 192 define an outer plenum 208 generally disposed radially outward from the combustion chamber 198. The inner combustor casing 180 and the inner liner 186 define an inner plenum 210 generally disposed radially inward with respect to the combustion chamber 198. As compressed air 176 is diffused by diffuser 178, some of the compressed air 176 flows radially outward into the outer plenum 208 and some of the compressed air 176 flows radially inward into the inner plenum 210.

The compressed air 176 flowing radially outward into the outer plenum 208 flows generally axially to the turbine section 120. Specifically, the compressed air 176 flows above and below the HP turbine stator vanes 164 and above the rotor blades 166. The outer plenum 208 may extend to the LP turbine 124 (FIG. 1) as well.

As further shown in FIG. 2, for the embodiment depicted, the HP turbine 122 includes a first stage 212 of turbine stator vanes 164 and a second stage 214 of turbine stator vanes 164 (as well as a first and second stage of turbine rotor blades 166). Moreover, for the embodiment depicted, the first stage 212 of turbine stator vanes 164 is of a variable configuration, such that the first stage 212 of turbine stator vanes 164 includes a plurality of variable vane assemblies, and more specifically, a plurality of variable guide vane assemblies 216.

For example, as is depicted schematically, each variable guide vane assembly 216 of the first stage 212 includes an actuation member 218 operable for rotating at least a portion of the variable guide vane assembly 216 along an axis 220.

Figure 3:
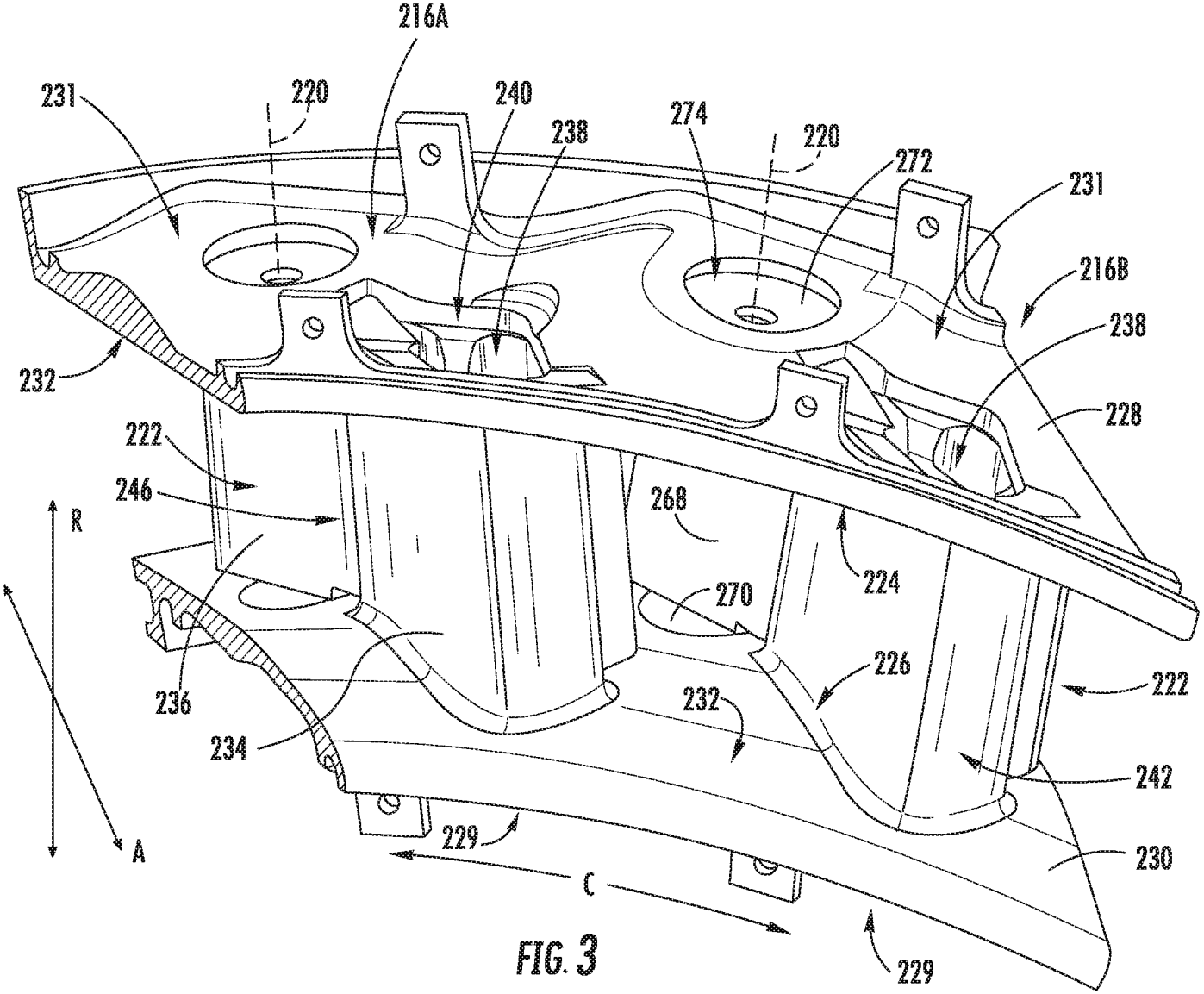
FIG. 3 is a perspective view of a first stage of variable guide vanes in a turbine section of the gas turbine engine shown in FIG. 1.

Referring now also to FIG. 3, a perspective view is provided of a portion of a plurality of the exemplary variable guide vane assemblies 216 of the first stage 212 of turbine stator vanes 164. The plurality of variable guide vane assemblies 216 are spaced generally along the circumferential direction C of the gas turbine engine 100 and generally include a first variable guide vane assembly 216A and a second variable guide vane assembly 216B (although they may be referred to herein generally with reference to numeral "216"). Each of the variable guide vane assemblies 216 includes an airfoil 222 extending generally along the radial direction R between a first, outer end 224 (i.e., an outer end along the radial direction R) and an opposite, second, inner end 226 (i.e., inner end 226 along the radial direction R). For the embodiment depicted, the axis 220 of each airfoil 222 is generally aligned with the radial direction R of the gas turbine engine 100. Moreover, each variable guide vane assembly 216 includes an airfoil band section, or more particularly, an outer airfoil band section 231 along the radial direction R and an inner airfoil band section 229 along the radial direction R. Notably, the inner airfoil band sections 229 of adjacent variable guide vane assemblies 216 may be formed together to form an inner airfoil band 230, and similarly the outer airfoil band sections 231 of adjacent variable guide vane assemblies 216 may be formed together to form an outer airfoil band 228.

Accordingly, it will be appreciated that the outer end 224 of each airfoil 222 is positioned adjacent to the respective outer airfoil band 228, and the inner end 226 of each airfoil 222 is positioned adjacent to the respective inner airfoil band 230. Additionally, the inner airfoil band 230 defines a flowpath surface 232 and the outer airfoil band 228 also defines a flowpath surface 232 (see also FIG. 2)—the flowpath surface 232 of the inner airfoil band 230 and the flowpath surface 232 of the outer airfoil band 228 each at least partially defining the core air flowpath 132 through the gas turbine engine 100.

Further, as noted, for the embodiment depicted the inner airfoil band sections 229 of adjacent variable guide vane assemblies 216 are coupled/formed together to form a substantially continuous inner airfoil band 230, and similarly, the outer airfoil band sections 231 of adjacent variable guide vane assemblies 216 are coupled/formed together to form a substantially continuous outer airfoil band 228. However, in other exemplary embodiments, the inner and outer airfoil bands 230, 228 may be configured in any other suitable manner. For example, in certain exemplary embodiments, the airfoil band sections of two adjacent variable guide vane assemblies 216 may be formed together in a doublet configuration (with two airfoil band sections formed integrally together, such as in the embodiment of FIG. 3), the airfoil band sections of three adjacent variable guide vane assemblies 216 may be formed together in a triplet configuration (with three band sections formed integrally together), the airfoil band section of a single variable guide vane assembly 216 may be formed as a singlet configuration, etc.

Furthermore, as will be appreciated, the airfoil 222 of each respective variable guide vane assembly 216 includes a first member and a second member. More specifically, for the embodiment depicted, the first member is a fixed member 234 and the second member is a variable member 236. The fixed member 234 is fixedly attached to or formed integrally with the inner airfoil band 230 and the outer airfoil band 228. Additionally, the variable member 236 of the airfoil 222 is movably coupled to the inner airfoil band 230 and outer airfoil band 228 about its axis 220. Further, as will be described in more detail below, for the embodiment depicted the fixed member 234 and the variable member 236 of the airfoil 222 of the respective variable guide vane assembly 216 together define an internal cavity 238 of the airfoil 222. The internal cavity 238 defined by the fixed member 234 and the variable member 236 of the airfoil 222 may be a cooling air cavity for the airfoil 222 and variable guide vane assembly 216. However, in other embodiments, the cavity 238 may have any other purpose or configuration, or may not be provided at all.

Figure 4:
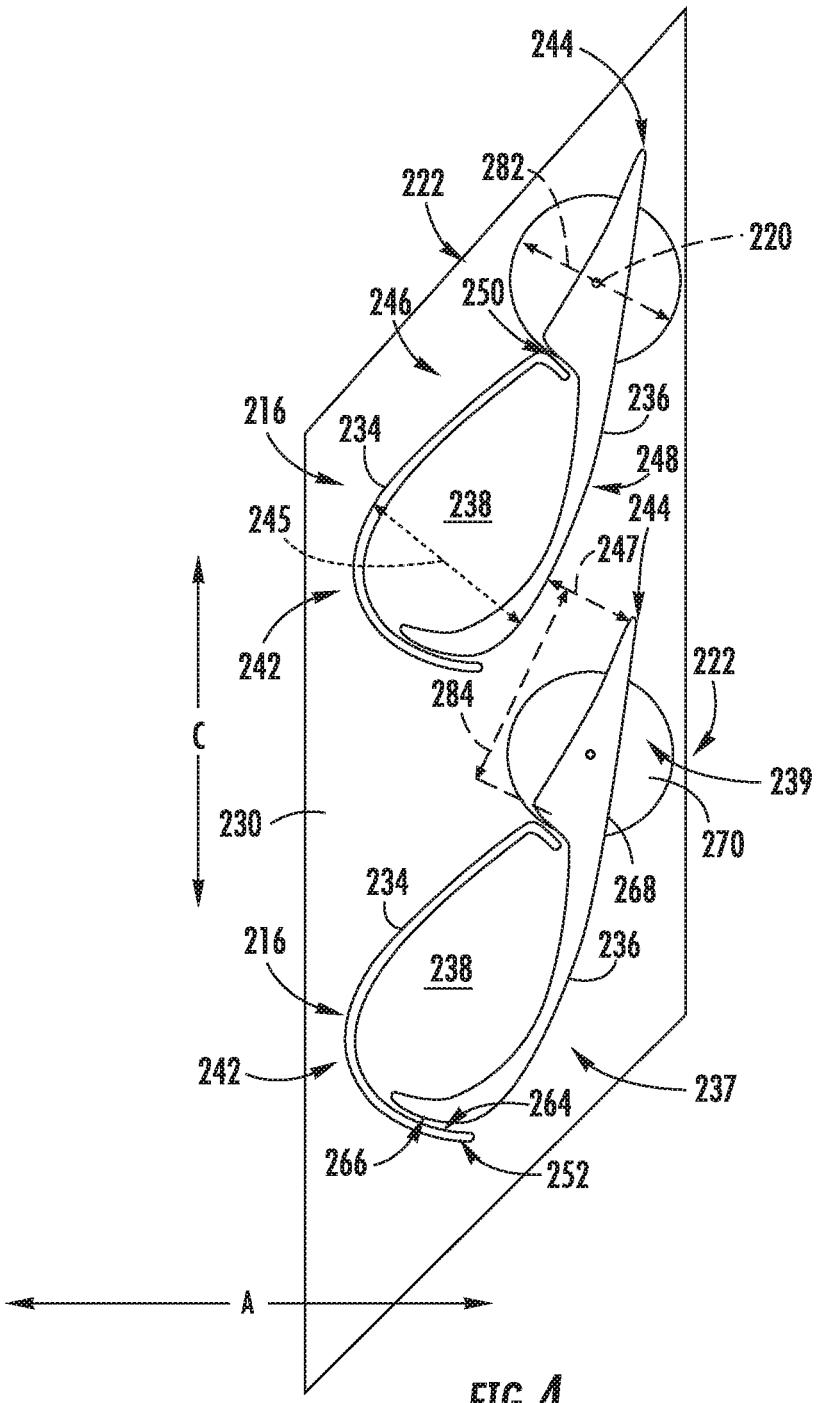
FIG. 4 is a cross-sectional view of the first stage of variable guide vanes of FIG. 3 in a first position.
Figure 5:
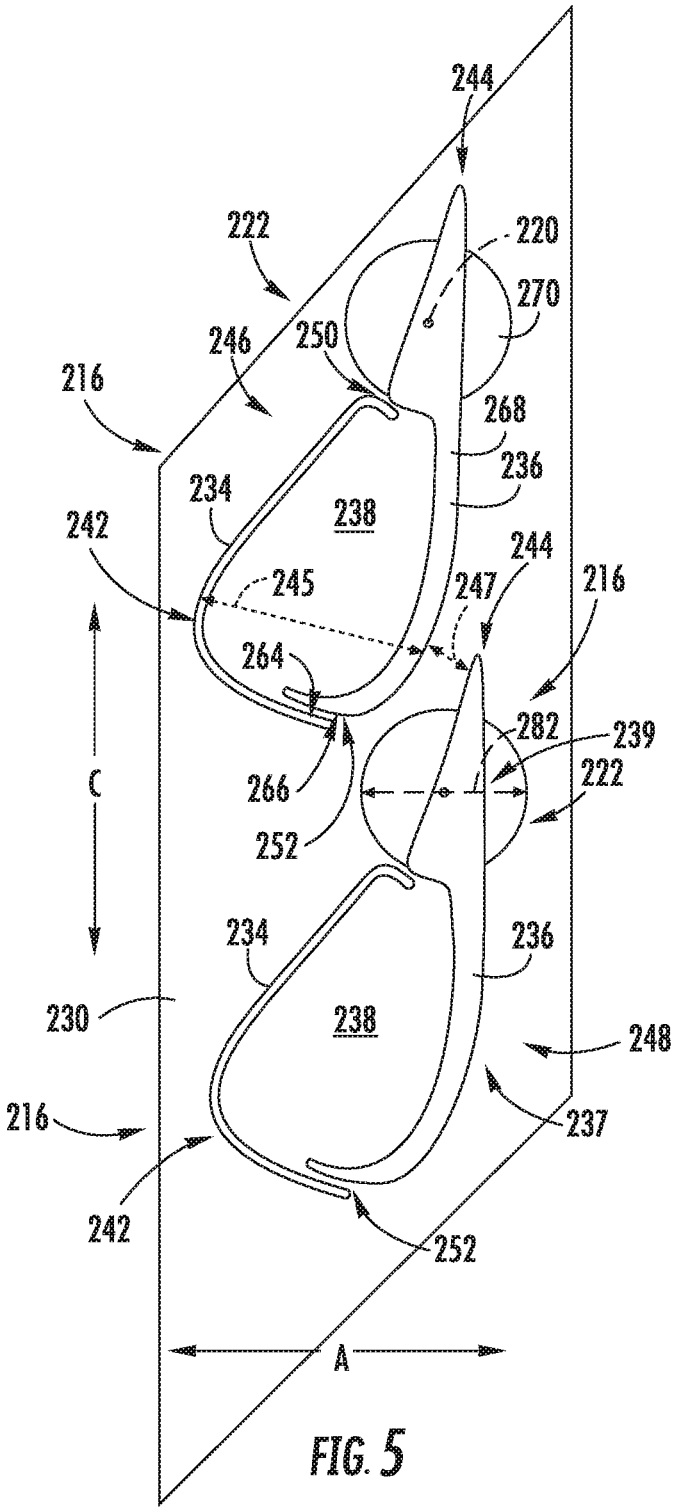
FIG. 5 is a cross-sectional view of the first stage of variable guide vanes of FIG. 3 in a second position.

Reference will now also be made to FIGS. 4 and 5. FIG. 4 provides a cross-sectional view of the exemplary variable guide vane assemblies 216 of FIG. 3 along the radial direction R, viewed towards the radially inner airfoil band 230, and in a first position; and FIG. 5 provides a cross-sectional view of the exemplary variable guide vane assemblies 216 of FIG. 3 also viewed along the radial direction R towards the radially inner airfoil band 230, but in a second position. More specifically, FIGS. 4 and 5 provide views of a first and second variable guide vane assembly 216A, 216B of the plurality of variable guide vane assemblies 216 in a stage of vanes (such as of a first stage 212 of turbine stator vanes 164, see FIG. 2).

As is depicted, the fixed member 234 and the variable member 236 of each airfoil 222 together define an airfoil-shaped cross-sectional shape. More specifically, the airfoil 222 of each variable guide vane assembly 216 generally defines a leading edge 242 at a forward end of the airfoil 222 and a trailing edge 244 at an aft end of the airfoil 222. Further, the airfoil 222 of each variable guide vane assembly 216 defines a pressure side 246, an opposite suction side 248, and a thickness 245. As will be explained in greater detail, below, the variable member 236 is moveable relative to the fixed member 234, such that the variable members 236 of adjacent variable guide vane assemblies 216, such as the variable members 236 of the first and second variable guide vane assemblies 216A, 216B, are moveable towards one another (and away from one another) during various operations. In such a manner, it will further be appreciated that adjacent airfoils 222 of adjacent variable guide vane assemblies 216 together define a throat having a throat distance 247 therebetween (i.e., for the embodiment depicted, the variable member 236 of the airfoil 222 of the first variable guide vane assembly 216A and the variable member 236 of the airfoil 222 of the second variable guide vane assembly 216B together define a throat distance 247 therebetween).

More specifically, for the embodiment of FIGS. 4 and 5, the variable members 236 each include an upstream section 237 and a downstream section 239. The upstream section 237 refers to a portion of the variable member 236 upstream of a pivot axis 220 (described below), and the downstream section 239 refers to a portion of the variable member 236 downstream of the pivot axis 220. For the embodiment depicted, the upstream section 237 of the variable member 236 of the airfoil 222 of the first variable vane assembly 216A is moveable towards the downstream section 239 of the variable member 236 of the airfoil 222 of the second variable vane assembly 216B. Further for the embodiment depicted, the downstream section 239 of the variable member 236 of the airfoil 222 of the second variable vane assembly 216B is moveable towards the upstream section 237 of the variable member 236 of the airfoil 222 of the first variable vane assembly 216A. In such a manner, the variable members 236 of adjacent variable guide vane assemblies 216 are moveable towards one another during various operations (see movement from FIG. 4 to FIG. 5), reducing a throat distance 247 therebetween more effectively.

Further, for the embodiment depicted, the variable members 236 of the airfoils 222 of the first and second variable vane assemblies 216A, 216B are moveable away from one another during other operations. More specifically, for the embodiment depicted the upstream section 237 of the variable member 236 of the airfoil 222 of the first variable vane assembly 216A is moveable away from the downstream section 239 of the variable member 236 of the airfoil 222 of the second variable vane assembly 216B, and the downstream section 239 of the variable member 236 of the airfoil 222 of the second variable vane assembly 216B is moveable away from the upstream section 237 of the variable member 236 of the airfoil 222 of the first variable vane assembly 216A. In such a manner, the variable members 236 of adjacent variable guide vane assemblies 216 are moveable away from one another during various operations (see movement from FIG. 5 to FIG. 4), increasing a throat distance 247 therebetween more effectively.

As will be further explained below, the more efficient increasing and decreasing of the throat distance 247 described above is accomplished by the present embodiment while reducing an airflow leakage over the radial ends of the airfoils 222 of the respective variable guide vane assemblies 216.

It will be appreciated, that as used herein, the term "thickness" generally refers to a distance between the pressure side 246 and the suction side 248 at a given location. Additionally, the term "maximum thickness" refers to the thickness at a location where the thickness measurement is greatest. Further, the term "throat distance" refers to a minimum distance between two adjacent airfoils 222 at a given radial location (i.e., location along the radial direction R) of the respective airfoils 222.

Referring still to FIGS. 4 and 5, for the embodiment depicted, the variable member 236 of each airfoil 222 extends substantially from the leading edge 242 to the trailing edge 244. Additionally, for the embodiment depicted, the suction side 248 of the airfoil 222 of each of the variable guide vane assembly 216 is defined substantially completely by the variable member 236 of the airfoil 222. By contrast, the pressure side 246 of the airfoil 222 of each variable guide vane assembly 216 is defined by both the variable member 236 and the stationary member 234 of the airfoil 222 for the embodiment shown.

As is also depicted in FIGS. 4 and 5, the variable member 236 of each airfoil 222 defines the axis 220, also referred to as a pivot axis. The pivot axis 220 is position proximate the trailing edge 244 of the airfoil 222. The variable member 236 is movable about the pivot axis 220 between, e.g., the first position shown in FIG. 4 and the second position shown in FIG. 5 to vary a direction in which an airflow across the airfoil 222 is directed during operation. Additionally, moving the variable member 236 about the pivot axis 220 between, e.g., the first position and the second position may modify a flow rate of the airflow (e.g., by modifying the distance 247 between adjacent airfoils 222). Accordingly, it will be appreciated that the movement about the pivot axis 220 facilitates, for the embodiment depicted, the movement of the variable members 236 of airfoils 222 of adjacent variable guide vane assemblies 216 (e.g., assemblies 216A, 216B) towards each other and away from each other in the manner described above.

Further, in order to maintain a desired seal between the variable member 236 and the fixed member 234 during the movement of the variable member 236 about the pivot axis 220 (and, e.g., allowing for a minimal amount of leakage from the cavity 238, if desired), the fixed member 234 and the variable member 236 of each airfoil 222 together form a first seal interface 250 and a second seal interface 252. The first seal interface 250 is located aft of the second seal interface 252, such that the variable member 236 and fixed member 234 are arranged in a staggered manner. Additionally, the first seal interface 250 and the second seal interface 252 each extend along the radial direction R between the radially inner end 226 of the airfoil 222 and the radially outer end 224 of the airfoil 222 (see also, FIG. 3). The first seal interface 250 and second seal interface 252 provide a substantially airtight seal between the fixed member 234 and variable member 236 of the airfoil 222 of the variable guide vane assembly 216 despite a movement of the variable member 236 between various position relative to the fixed members 234.

For the airfoil 222 of each variable guide vane assembly 216 depicted, the first seal interface 250 is positioned on the pressure side 246 of the airfoil 222 and the second seal interface 252 is positioned proximate the leading edge 242 of the airfoil 222. More specifically, for the embodiment depicted, the second seal interface 252 is positioned at the leading edge 242 of the airfoil 222. In such a manner it will be appreciated that for the embodiment depicted the fixed member 234 of the airfoil 222 of each variable guide vane assembly 216 defines at least the pressure side 246 between the first and second seal interfaces 250, 252 (as well as a portion of the suction side 248), while the variable member 236 of the airfoil 222 of each variable guide vane assembly 216 defines the pressure side between the first seal interface 250 and the trailing edge 244, and most all of the suction side 248 (such as at least about 60%, such as at least about 70%, such as at least about 80% of the suction side 248). More specifically, for the embodiment shown, the variable member 236 of the airfoil 222 defines the suction side between the trailing edge 244 and the throat (defined with an adjacent airfoil 222, i.e., where the minimum throat distance 247 is defined). Notably, as used herein, the term "positioned proximate the leading edge 242" refers to being closer to the leading edge 242 than the trailing edge 244, and "positioned proximate the trailing edge 244" refers to being position closer to the trailing edge 244 than the leading edge 242.

Figure 6:
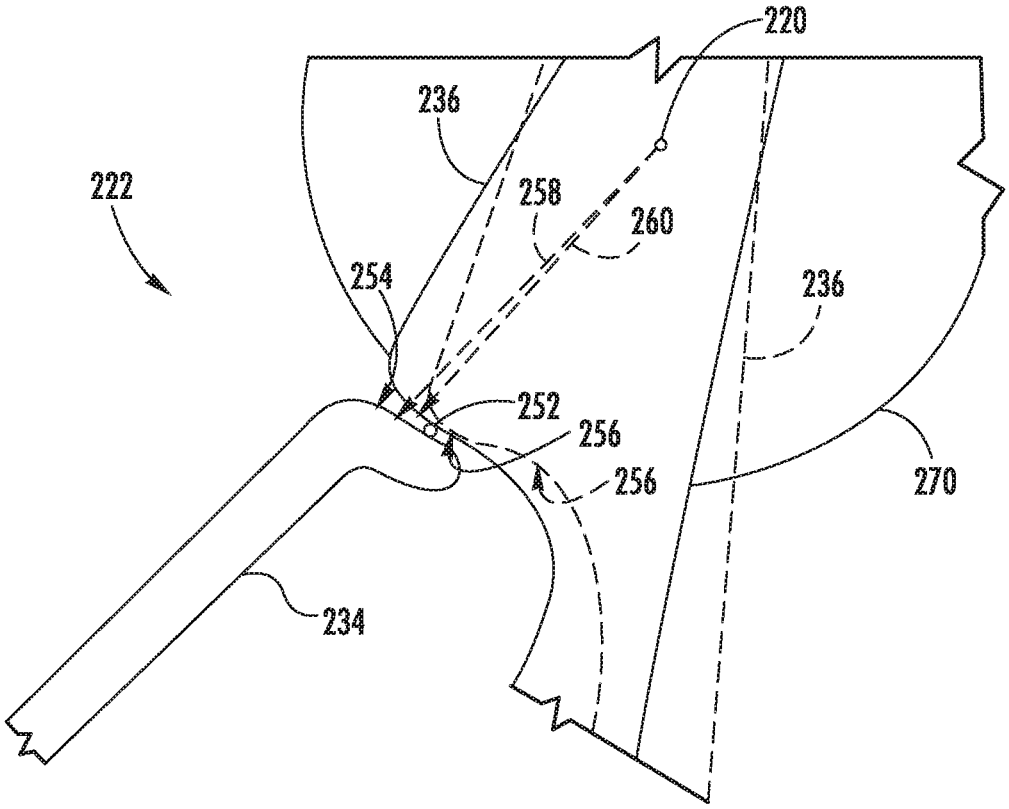
FIG. 6 is close-up, cross-sectional view of a first seal interface of a variable guide vane of the first stage of variable guide vanes of FIG. 3.

Moreover, referring now also to FIG. 6, providing a close-up, cross-sectional view of the first seal interface 250, it will be appreciated that the first seal interface 250 is formed by a first fixed seal surface 254 of the fixed member 234 of the airfoil 222 and a first variable seal surface 256 of the variable member 236 of the airfoil 222. The first fixed seal surface 254 defines an arcuate shape in a reference plane. The reference plane is a plane extending perpendicular to the pivot axis 220 (i.e., in the view shown in FIGS. 4 through 6). Additionally, the first variable seal surface 256 also defines an arcuate shape in the reference plane. More specifically, for the embodiment depicted, the arcuate shape of the first fixed seal surface 254 defines a radius 258 substantially equal to a distance between the first fixed seal surface 254 and the pivot axis 220, and further, the arcuate shape of the first variable seal surface 256 defines a radius 260 substantially equal to a distance between the first variable seal surface 256 and the pivot axis 220. Notably, for the embodiment shown, the radii 258, 260 each originates at the axis 220. In such a manner, a clearance between the first variable seal surface 256 in the first fixed seal surface 254 may be maintained substantially constant despite a movement of the variable member 236 between, e.g., the first position and the second position. It will be appreciated, however, that in other exemplary embodiments of the present disclosure, the shapes of the seal surfaces 254, 256 may be formed in other non-arcuate configurations (such as other rounded shapes, or linear shapes).

It will also be appreciated that for the embodiment depicted, the first seal interface 250 further includes a seal element 252 positioned between the first variable seal surface 256 and the first fixed seal surface 254. The seal element 252 may extend generally along the radial direction R and may be any suitable material for assisting with the forming of a seal between the first fixed seal surface 254 and the first variable seal surface 256.

Referring now back to FIGS. 4 and 5, it will be appreciated that the second seal interface 252 is similarly formed of a second fixed seal surface 264 and a second variable seal surface 266. The second fixed seal surface 264 and second variable seal surface 266 each also define an arcuate shape in the reference plane perpendicular to the pivot axis 220. More specifically, the second fixed seal surface 264 and second variable seal surface 266 each define an arcuate shape having a radius substantially equal to a distance between the second fixed seal surface 264 and the pivot axis 220 and the second variable seal surface 266 and the pivot axis 220, respectively (radii not labeled). The radii for each of the surfaces 264, 266 may similarly originate at the pivot axis 220. Additionally, although not depicted, the second seal interface 252 may further include a sealing element positioned between the surfaces 264, 266. It will be appreciated, however, that in other exemplary embodiments of the present disclosure, the shapes of the seal surfaces 264, 266 may be formed in other non-arcuate configurations.

Referring still to FIGS. 4 and 5, it will be appreciated that the variable member 236 of the airfoil 222 of each variable guide vane assembly 216 generally includes a body 268 and a circular base. More specifically, the variable member 236 of the airfoil 222 of each variable guide vane assembly 216 includes an inner circular base 270 and an outer circular base 272 (see FIG. 3). The inner circular base 270 and outer circular base 272 of the variable member 236 of each airfoil 222 is fixedly attached to or formed integrally with the body 268 of the variable member 236 of the respective airfoil 222.

Figure 7:
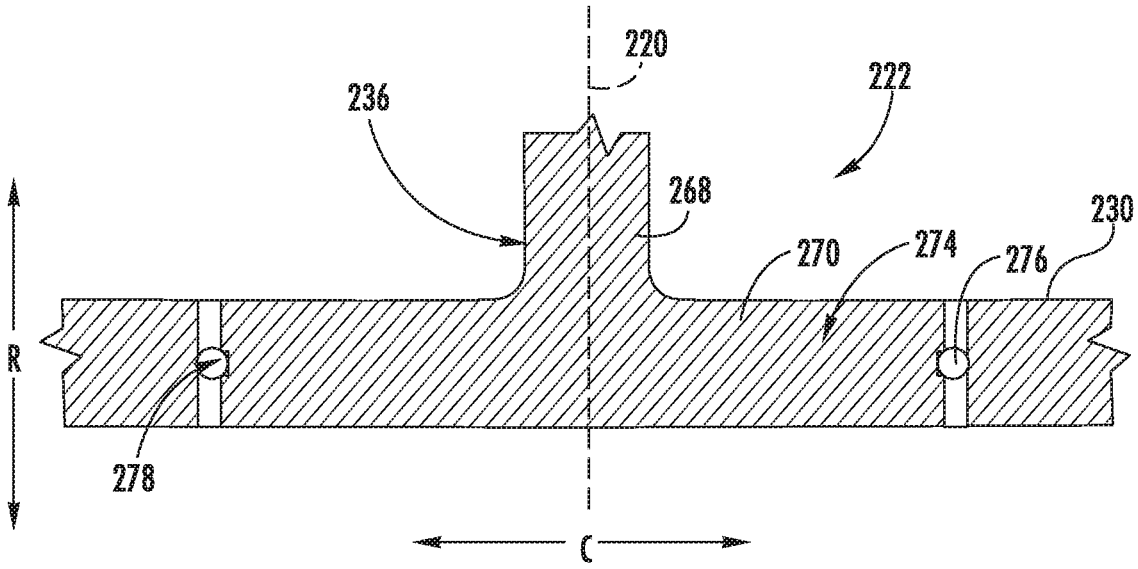
FIG. 7 is a cross-sectional view of an end of a variable guide vane of the first stage of variable guide vanes of FIG. 3.

Referring now also to FIG. 7, providing a close-up, schematic, cross-sectional view of the inner circular base 270 of the variable member 236 of one of the airfoils 222 of the variable guide vane assemblies 216 of FIGS. 4 and 5, it will further be appreciated that the radially inner airfoil band 230 and the radially outer airfoil band 228 each define a circular opening 274 (see also FIG. 3). The inner circular base 270 of the variable member 236 of each airfoil 222 is movably received within the circular opening 274 of the radially inner airfoil band 230 about the pivot axis 220, and further, the outer circular base 272 of the variable member 236 of each airfoil 222 is movably received within the circular opening 274 of the radially outer airfoil band 228 also about the pivot axis 220 (see also FIG. 3). More specifically, the variable member 236 of the airfoil 222 includes a seal 276 positioned between the inner circular base 270 and the inner airfoil band 230, or more specifically still, positioned in a channel 278 extending around an outer edge of the inner circular base 270 and a wall of the radially inner airfoil band 230 defining the opening 274. In such a manner, the intersection between the inner circular base 270 and the radially inner airfoil band 230 may be an airtight seal. It will be appreciated that the outer circular base 272 may be configured in a similar manner as the inner circular base 270, and therefore an intersection between the outer circular base 272 and the radially outer airfoil band 228 may also be an airtight seal including a seal (similar to seal 276). It should be appreciated that the channel 278 with the seal 276 positioned therein is, for the embodiment depicted, positioned in the circular opening 274 of the radially inner airfoil band 230.

Referring again to FIGS. 4 and 5, it will further be appreciated that the inner circular base 270 and outer circular base 272 of variable member 236 of each airfoil 222 is relatively large to ensure a desired amount of airfoil sealing is achieved between the variable member 236 of the airfoil 222 and the radially inner airfoil band 230 and radially outer airfoil band 228. More specifically, as is depicted in, e.g., FIG. 4, the variable member 236 of the airfoil 222 defines a pressure side length 284 (i.e., a pressure side length 284 of the variable member 236) between the first seal interface 250 and the trailing edge 244. More specifically, for the embodiment depicted, the pressure side length 284 is a straight line length from the first fixed seal surface 254 to the trailing edge 244 in a direction perpendicular to the pivot axis 220. It will further be appreciated that the inner circular base 270 defines a diameter 282 also in a direction perpendicular to the pivot axis 220. (In at least certain embodiments, the outer circular base 272 also defines a diameter in the direction perpendicular to the pivot axis 220 that is equal to the diameter 282 of the inner circular base 270 in the direction perpendicular to the pivot axis 220. Alternatively, however, the diameter of the outer circular base 272 may be different than the diameter 282 of the inner circular base 270.) For the embodiment depicted, the diameter 282 of the inner circular base 270 is greater than or equal to about fifty percent of the pressure side length 284. More specifically, for the embodiment depicted, the diameter 282 the circular base is greater than or equal to about seventy-five percent of the pressure side length 284 and less than or equal to about one hundred and twenty percent of the pressure side length 284, such as greater than or equal to about ninety percent of the pressure side length 284, such as greater than or equal to about one hundred percent of the pressure side length 284.

Therefore, it will be appreciated that inclusion of a variable guide vane assembly in accordance with one or more these exemplary embodiments may result in a more efficient variable guide vane assembly as an amount of air leakage over a radially outer or radially inner portion of an airfoil of the variable guide vane assembly is minimized. More specifically, a fixed member of an airfoil in accordance with one or more these embodiments may be attached to, or formed with, the radially inner and radially outer airfoil bands in a manner to ensure no airflow leakage is allowable over a radially inner and/or radially outer portion of the fixed member. Moreover, a variable member of an airfoil in accordance with one or more these embodiments may form an airtight seal with the fixed member through a first and second seal interface. Further, the variable member may include an inner circular base and/or an outer circular base forming an airtight seal with the radially inner band and/or the radially outer band, respectively. An intersection of a body portion of the airfoil and the inner and/or outer circular base may be formed such that no airflow is able to flow therebetween either. Accordingly, the variable guide vane assembly in accordance with one or more these embodiments may allow for varying an effective airflow direction thereacross without allowing any substantial amount of airflow leakage around radially inner and/or radially outer portions thereof. Such may therefore lead to a more efficient engine.

It should be appreciated, however, that in other exemplary embodiments, the variable guide vane assemblies may be configured in any other suitable manner. For example, in other exemplary embodiments, the fixed member of the airfoil may be positioned on the suction side of the airflow, and the variable member may instead form the pressure side of the airflow. Further, in other exemplary embodiments, the pivot axis may be positioned further forward than is shown in the embodiment of FIGS. 4 through 6. Further, still, in other embodiments, the first member of the airfoil may additionally be movable relative to an inner and outer airfoil band. Moreover, in other embodiments, the first member may substantially completely form a forward section of the airfoil, and the second member may substantially completely form and aft section of the airfoil (e.g., a tail section). With such an embodiment, the second, variable member may include the inner circular base and/or outer circular base to form a seal with the inner airfoil band and/or outer airfoil band, respectively. Further, it should be appreciated that in still other exemplary embodiments, the variable guide vane assemblies described herein may not be "guide" vanes, and instead may be any other suitable variable vane positioned at any suitable position within a machine.

Additionally, although the variable guide vane assemblies depicted are described as being in a high pressure turbine, in other exemplary embodiments, the variable guide vane assemblies may instead be positioned, e.g., in a low pressure turbine, an intermediate turbine (if provided), etc. Moreover, in other exemplary embodiments, the variable guide vane assemblies may instead be positioned in, e.g., a compressor section of a gas turbine engine. Further, although described herein as being included within sections of a gas turbine engine, in other exemplary embodiments, the variable vanes may instead be positioned within any suitable machine having an airflow path. For example, in other embodiments, the variable vane assemblies may instead be positioned in, or otherwise configured for use with, a steam turbine, a compressor (e.g., a dedicated or standalone compressor, or a compressor incorporated into a larger machine), etc.

Figure 8:
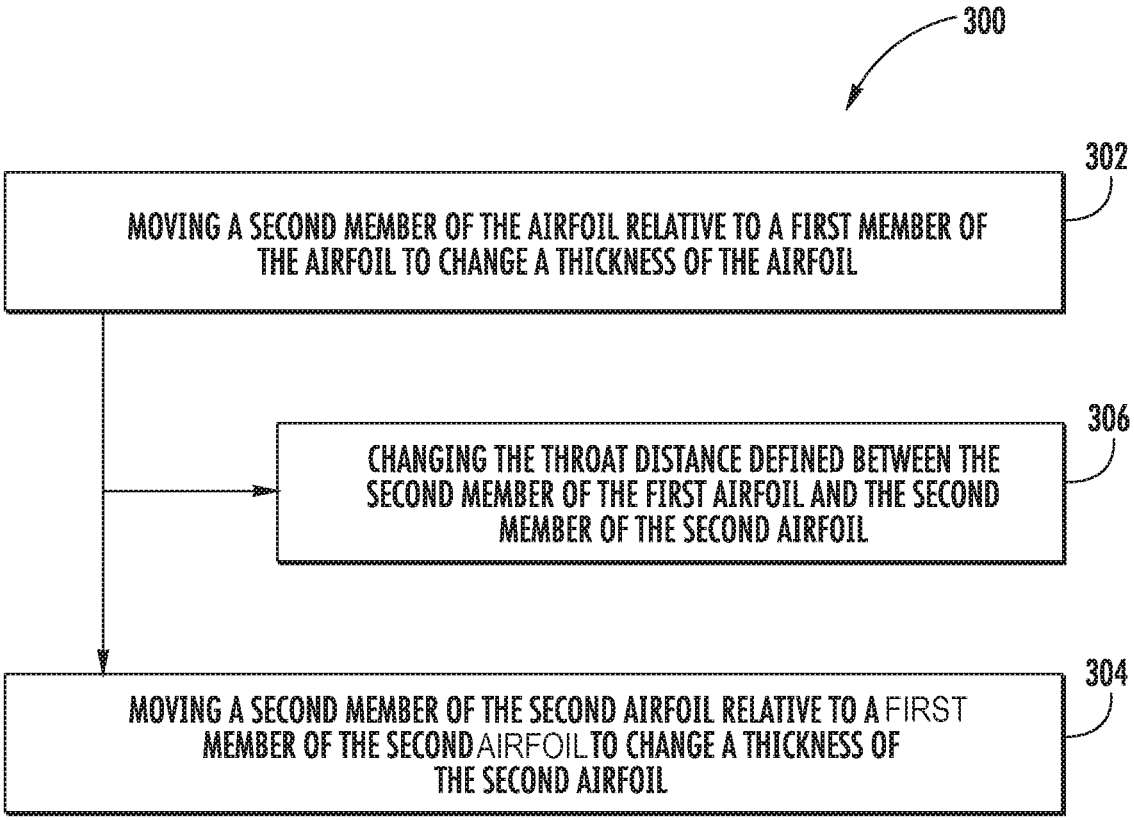
FIG. 8 is a flow diagram of a method for modifying an airflow through an airflow path.

Referring now to FIG. 8, a flow diagram of a method 300 for modifying an airflow through an airflow path of a machine using a variable vane assembly is provided. The method 300 may be utilized with one or more the exemplary variable vanes described above with reference to FIGS. 1 through 6. Accordingly, the variable vane assembly may generally include an airfoil band and an airflow and may be positioned in a turbine section of the gas turbine engine. Of course, in other exemplary aspects, the variable vane assembly may instead be positioned within any other suitable section of the gas turbine engine, or alternatively, within any other suitable machine.

As is depicted, the method 300 generally includes at (302) moving a second member of the airfoil relative to a first member of the airfoil to change a thickness of the airfoil. The first and second members of the airfoil each extend from the airflow band generally along the radial direction of the machine.

Additionally, for the exemplary aspect depicted, the airfoil is configured as a first airfoil and the variable vane assembly further comprises a second airfoil. With such an exemplary aspect, the method 300 further includes at (304) moving a second member of the second airfoil relative to a first member of the second airfoil to change a thickness of the second airfoil. The first and second members of the second airfoil each extend from the airflow band generally along the radial direction of the machine.

It will be appreciated that for the exemplary aspect depicted, the first airfoil may be positioned adjacent to the second airfoil, e.g., along a circumferential direction of the machine. With such an exemplary aspect, the second member of the first airfoil and the second member of the second airfoil together define a throat distance therebetween. Further, with such an exemplary aspect, moving the second member of the first airfoil relative to the first member of the first airfoil at (302) may further include at (306) changing the throat distance defined between the second member of the first airfoil and the first member of the second airfoil.

Such may allow for the variable vane assembly to further modify an airflow thereacross by increasing and/or decreasing a throat distance between adjacent airfoils, allowing for an increased and/or decreased, respectfully, amount of airflow thereacross during operation of the machine.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stage of guide vanes for a machine defining a radial direction, the stage of guide vanes comprising:

a first variable vane assembly comprising an airfoil, the airfoil of the first variable vane assembly comprising a first member and a second member each extending generally along the radial direction and the second member being moveable relative to the first member; and a second variable vane assembly comprising an airfoil, the airfoil of the second variable vane assembly comprising a first member and a second member each extending generally along the radial direction and the second member being moveable relative to the first member, the second members of the airfoils of the first and second variable vane assemblies being moveable towards one another.

2. The stage of guide vanes of claim 1, wherein the second members are variable members, and wherein the first members are fixed members.

3. The stage of guide vanes of claim 1, wherein the second members each comprise an upstream section and a downstream section, wherein the upstream section of the second member of the airfoil of the first variable vane assembly is moveable towards the downstream section of the second member of the airfoil of the second variable vane assembly, and wherein the downstream section of the second member of the airfoil of the second variable vane assembly is moveable towards the upstream section of the second member of the airfoil of the first variable vane assembly.

4. The stage of guide vanes of claim 1, wherein the second members of the airfoils of the first and second variable vane assemblies are further moveable away from one another.

5. The stage of guide vanes of claim 4, wherein the second members each comprise an upstream second and a downstream section, wherein the upstream section of the second member of the airfoil of the first variable vane assembly is moveable away from the downstream section of the second member of the airfoil of the second variable vane assembly, and wherein the downstream section of the second member of the airfoil of the second variable vane assembly is moveable away from the upstream section of the second member of the airfoil of the first variable vane assembly.

6. The stage of guide vanes of claim 1, wherein the airfoils each define a suction side, a pressure side, a leading edge, and a trailing edge, wherein the second member of each airfoil defines the suction side generally between a respective trailing edge and a throat.

7. The stage of guide vanes of claim 6, wherein the airfoils each extend between a radially inner end and a radially outer end, wherein the first member and the second member of each airfoil together form a first seal interface and a second seal interface, wherein the first seal interface and the second seal interface of each airfoil extends along the radial direction between the radially inner end and the radially outer end of the respective airfoil, wherein the first seal interface of each airfoil is located on the pressure side of the respective airfoil, and wherein the second member further defines the pressure side between the trailing edge and the first seal interface.

8. The stage of guide vanes of claim 7, wherein the second seal interface of each airfoil is positioned proximate the leading edge of the respective airfoil, and wherein the first member of each airfoil defines at least the pressure side of the respective airfoil between the first seal interface and the second seal interface.

9. The stage of guide vanes of claim 7, wherein the first seal interface further includes a seal element positioned between the first variable seal surface and the first fixed seal surface.

10. The stage of guide vanes of claim 1, wherein the first and second variable vane assemblies each further comprise an airfoil band section, wherein each airfoil defines a leading edge and a trailing edge, wherein the second member of each airfoil is a variable member moveably coupled to the respective airfoil band section and defining a pivot axis, and wherein the pivot axis of the second member of each airfoil is positioned proximate the trailing edge of the respective airfoil.

11. The stage of guide vanes of claim 1, wherein the first and second variable vane assemblies each further comprise an airfoil band section, wherein the first member of each airfoil is a fixed member fixedly positioned relative to the respective airfoil band section, wherein the second member of each airfoil is a variable member moveably positioned relative to the respective airfoil band section and defining a pivot axis, wherein the fixed member and the variable member of each airfoil together define a first seal interface, wherein the first seal interface of each airfoil is formed by a first fixed seal surface of the respective fixed member and a first variable seal surface of the respective variable member, wherein the respective first fixed seal surface defines a curved shape in a reference plane perpendicular to the respective pivot axis, and wherein the respective first variable seal surface also defines a curved shape in the reference plane perpendicular to the respective pivot axis.

12. The stage of guide vanes of claim 1, wherein the first and second variable vane assemblies each further comprise an airfoil band section, wherein the second member of each airfoil is a variable member moveably coupled to the respective airfoil band section and defining a pivot axis, wherein each variable member comprises a body and a circular base attached to or formed integrally with the body, wherein each airfoil band section defines a circular opening, and wherein the circular base of the variable member of the airfoil of each variable vane assembly is movably received within the circular opening of the airfoil band section of the respective variable vane assembly.

13. The stage of guide vanes of claim 12, wherein the first member of each airfoil is a fixed member fixedly attached to, or formed integrally with, the airfoil band section of the respective variable vane assembly, wherein the fixed member and the variable member of each airfoil together form a first seal interface and a second seal interface, wherein each airfoil defines a pressure side and a trailing edge, wherein the first seal interface of each airfoil is positioned on the pressure side of the respective airfoil, wherein each variable member defines a pressure side length between the respective first seal interface and the trailing edge, wherein the circular base of each variable member defines a diameter, and wherein the diameter of each circular base is greater than or equal to about fifty percent of the pressure side length of the respective variable member.

14. The stage of guide vanes of claim 12, wherein each variable member further comprises a seal positioned between the circular base and the respective airfoil band section.

15. The stage of guide vanes of claim 1, wherein the stage of guide vanes is a stage of variable guide vane assemblies, wherein the machine is a gas turbine engine, and wherein the stage of variable guide vane assemblies is configured for installation within a turbine section of the gas turbine engine.

16. A variable vane assembly for a machine, the variable vane assembly comprising:

an airfoil band defining a circular opening; and an airfoil comprising a first member and a second member, the first member being a fixed member and the second member being a variable member, the fixed member and the variable member together defining a pressure side of the airfoil, the variable member substantially defining a suction side of the airfoil, wherein the variable member comprises a body and a circular base attached to or formed integrally with the body, the circular base being movably received within the circular opening of the airfoil band.

17. The variable vane assembly of claim 16, wherein the first member is fixedly attached to, or formed integrally with, the airfoil band.

18. A variable vane assembly for a machine, the variable vane assembly comprising:

an airfoil defining a leading edge, a trailing edge, a pressure side, and a suction side, the airfoil comprising a fixed member and a variable member each extending generally along the radial direction and the variable member being moveable relative to the fixed member, the variable member substantially defining the suction side and the fixed member and variable member together defining the pressure side.

19. The variable vane assembly of claim 18, wherein the airfoil extends between a radially inner end and a radially outer end, wherein the fixed member and the variable member together form a first seal interface and a second seal interface, wherein the first seal interface and the second seal interface each extend along the radial direction between the radially inner end and the radially outer end, wherein the first seal interface is located on the pressure side, and wherein the variable member defines the pressure side between the trailing edge and the first seal interface.

20. The variable vane assembly of claim 19, wherein the second seal interface is positioned proximate the leading edge of the airfoil, and wherein the fixed member defines the pressure side between the first seal interface and the second seal interface.

* * * * *